United States Patent [19]

Dixon

[11] 4,242,900

[45] Jan. 6, 1981

[54] PARTS UNLOADING MECHANISM

[75] Inventor: Paul H. Dixon, Belvidere, Ill.

[73] Assignee: Dixon Automatic Tool, Inc., Rockford, Ill.

[21] Appl. No.: 55,986

[22] Filed: Jul. 9, 1979

[51] Int. Cl.[3] ..... B21D 45/00

[52] U.S. Cl. ..... 72/345; 72/427; 83/82; 414/680; 414/742; 414/743

[58] Field of Search ..... 72/344, 345, 427; 83/81, 82, 157, 165; 414/680, 742, 743, 728

[56] References Cited

U.S. PATENT DOCUMENTS

| | | | |
|---|---|---|---|
| 3,148,571 | 9/1964 | Wallis | 83/82 |
| 3,653,293 | 4/1972 | Wallis | 83/82 |
| 3,893,358 | 7/1975 | Dixon | 83/82 |

*Primary Examiner*—Leon Gilden

*Attorney, Agent, or Firm*—Leydig, Voit, Osann, Mayer & Holt, Ltd.

[57] ABSTRACT

A mechanism for unloading a part which is retracted upwardly with a tool and which remains on the tool as the latter begins its downward stroke. The mechanism includes a tray which initially is moved into position to remove the part from the tool as the tool starts through its downward stroke. After removing the part, the tray catches the part and then shifts clear of the downwardly moving tool and discharges the part.

6 Claims, 7 Drawing Figures

PARTS UNLOADING MECHANISM

BACKGROUND OF THE INVENTION

This invention relates to a mechanism for unloading a part from a machine of the type which includes a movable tool adapted to be reciprocated through upward and downward strokes. As the tool is retracted through its upstroke, the part moves upwardly with the tool and then remains on the tool as the tool starts through its downstroke.

SUMMARY OF THE INVENTION

The general aim of the present invention is to provide a new and improved unloading mechanism which removes the part from the tool as the tool starts downwardly, which catches the removed part and which then moves clear of the tool and discharges the part.

A related object is to provide unloading mechanism having a tray which not only is moved between part receiving and part discharging positions in timed relation with upward and downward movement of the tool but which also is shifted with a supplemental motion in order to effect removal of the part from the tool.

A more detailed object is to achieve the foregoing by providing an unloading mechanism in which the tray is mounted to swing between its part receiving and part discharging positions about a pivot which is adapted to be uniquely shifted to impart the supplemental removal motion to the tray.

These and other objects and advantages of the invention will become more apparent from the following detailed description when taken in conjunction with the accompanying drawings.

DETAILED DESCRIPTION OF THE PREFERRED EMBODIMENT

Figure 1:
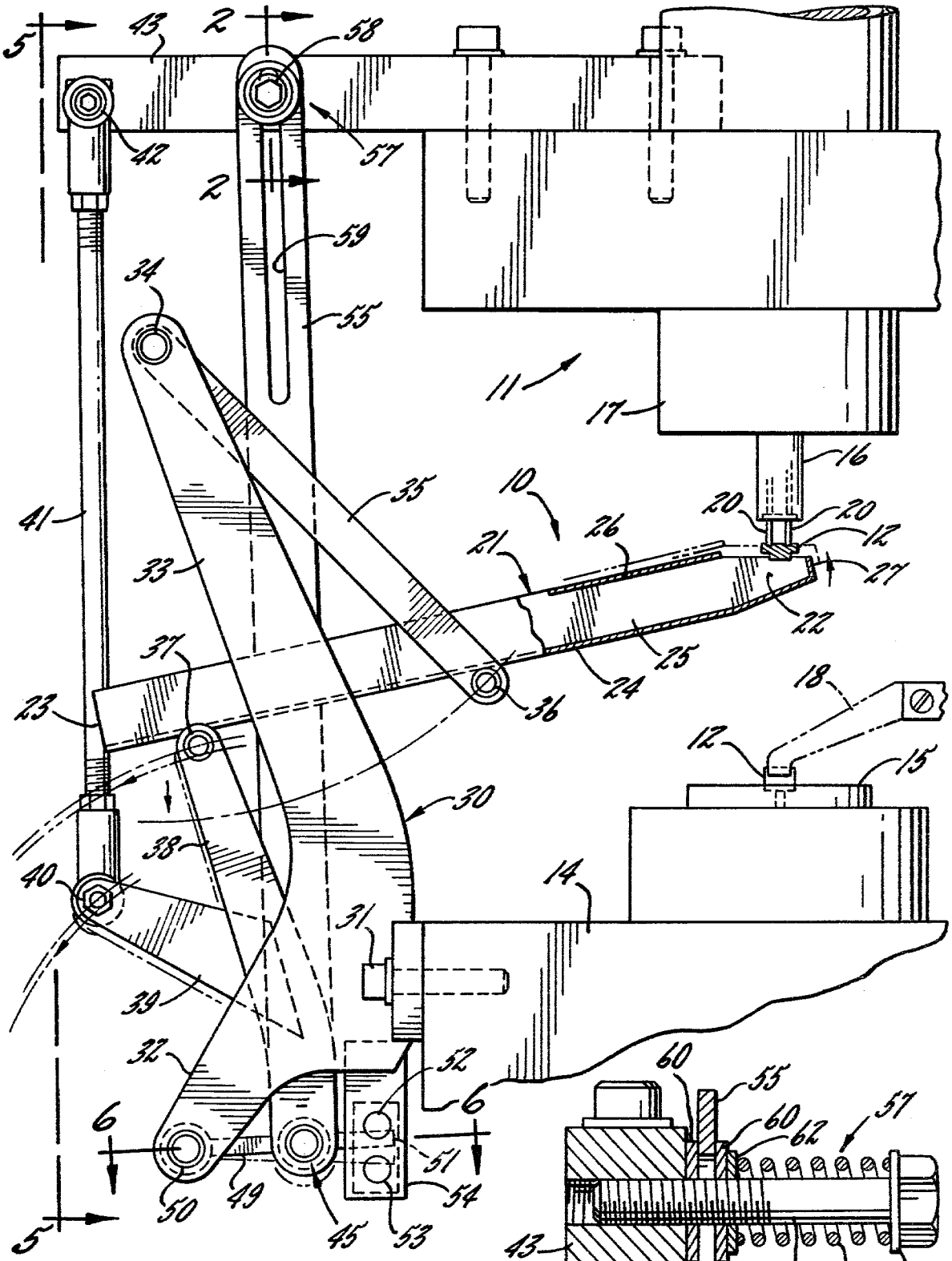
FIG. 1 is a fragmentary front elevational view of an exemplary machine equipped with a new and improved unloading mechanism incorporating the unique features of the present invention.

For purposes of illustration, the parts unloading mechanism 10 of the present invention is shown in the drawings as being associated with a machine such as a punch press 11 which is operable to cold form a small metal part 12. The press is of conventional construction and comprises a stationary frame 14 which supports a fixed lower die 15. An upper tool or punch 16 is adapted to be reciprocated upwardly and downwardly by a drive ram 17 and coacts with the die to form the part into a desired shape.

Each time the punch 16 is retracted upwardly, a loading mechanism 18 (FIG. 1) places a part 12 onto the die 15. The loading mechanism is driven in timed relation with the ram 17 and is retracted out of the path of the punch as the latter moves downwardly to press the part against the die. When the punch 16 moves through its upstroke, the part 12 is retracted upwardly with the punch by virtue of the close fit between the punch and the part. As the punch nears the end of its upstroke, four angularly spaced knock-out pins 20 move downwardly and force the part 12 off of the lower end of the punch. The part, however, remains on the lower ends of the knock-out pins since, during the punching operation, the knock-out pins engaged the part and formed small dimples in the upper side thereof. Because of the close fit between the dimples and the pins, the part does not fall off of the pins when the latter knock the part from the punch.

The present invention contemplates a new and improved unloading mechanism 10 having a tray 21 which is uniquely adapted to first remove the part 12 from the knock-out pins 20 and then to catch the part and unload the part from the punch press 11. The unloading mechanism is particularly characterized by the fact that the tray 21 moves between part receiving and part unloading positions in timed relation with upward and downward movement of the punch 16 and yet is capable, when in its part receiving position and when the punch initially moves downwardly, to move along a path enabling the part to be removed from the pins 20.

More specifically, the tray 21 is inclined downwardly and outwardly from the punch 16 (see FIG. 1) and includes an inner part receiving end 22 and an outer part discharging end 23. The tray is made of sheet metal and is of generally U-shaped cross-section. Thus, the tray includes a bottom wall 24 and upstanding side walls 25. A top wall 26 spans the side walls 25 near the inner part receiving end portion 22 of the tray but leaves the extreme inner end of the tray exposed so that parts 12 may drop into the tray.

In carrying out the invention, an upstanding lip 27 (FIGS. 1 and 3) is formed integrally with and projects upwardly from the bottom wall 24 of the tray 21 at the extreme inner end thereof and is used for removing parts 12 from the knock-out pins 20. The outer or discharge end 23 of the tray is open so that parts may slide out of the tray and into a receiving bin 28 (FIG. 4) or the like.

Figures 3, 4:
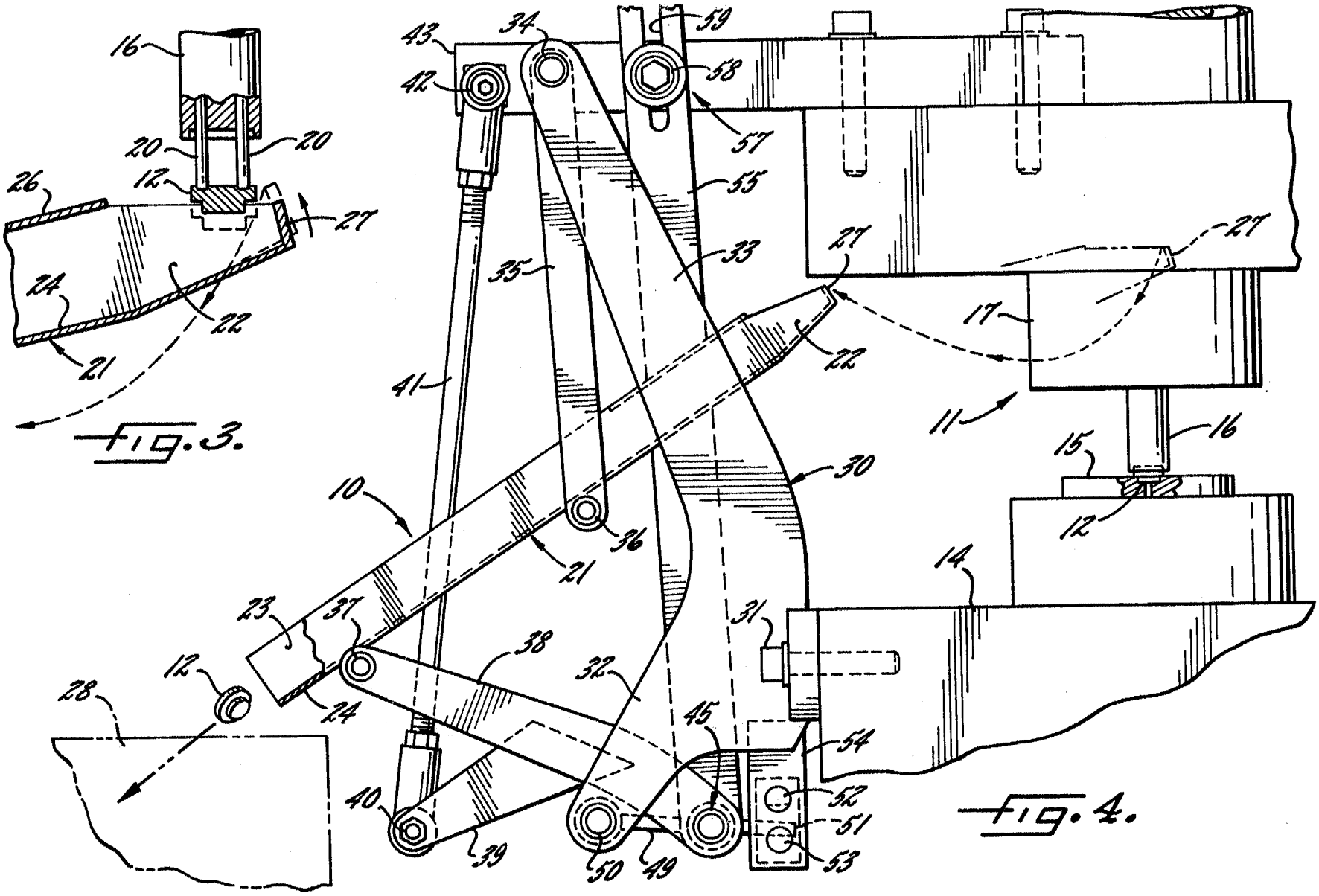
FIG. 3 is an enlarged view of certain parts which are shown in FIG. 1.
FIG. 4 is a view similar to FIG. 1 but shows certain parts in moved positions.
Figure 5:
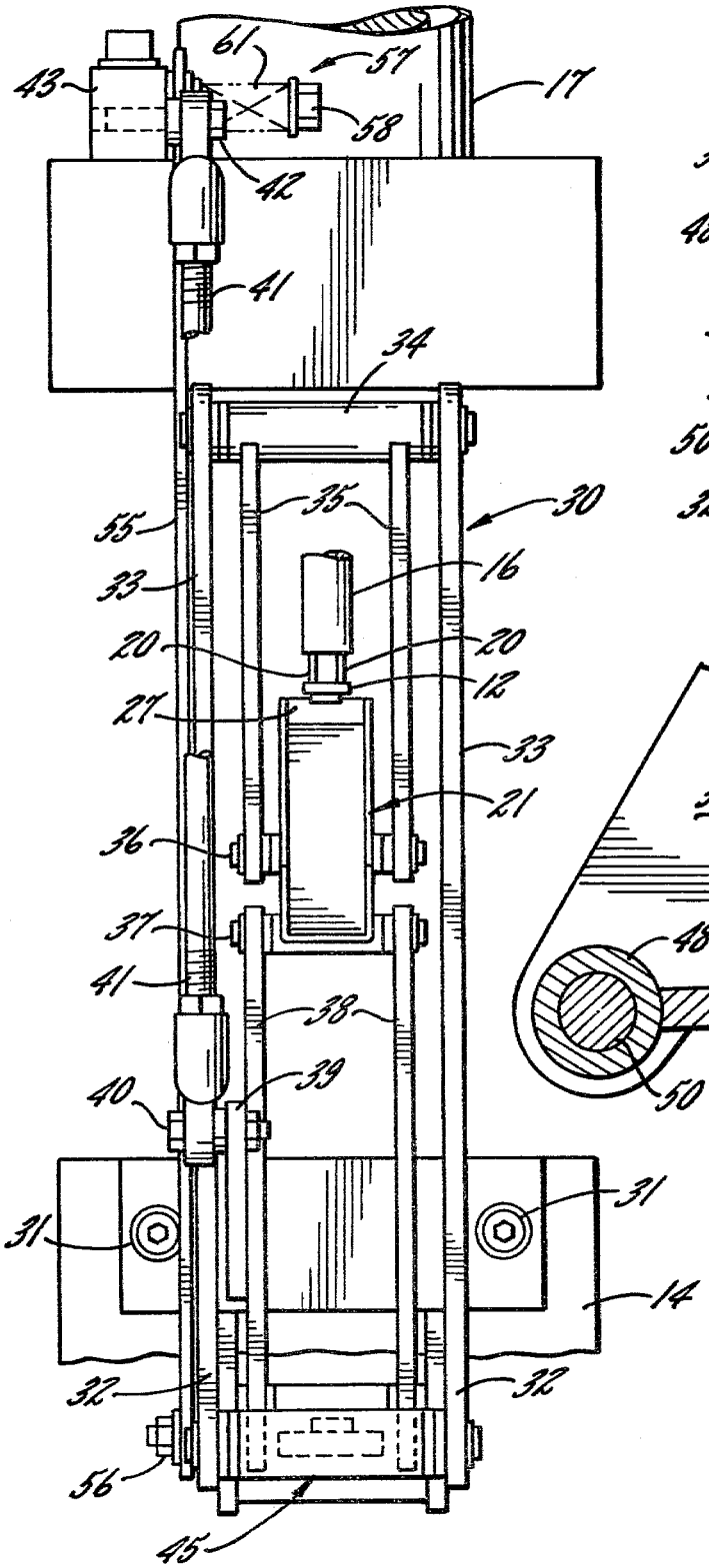
FIG. 5 is a side elevational view as taken substantially along the line 5—5 of FIG. 1.

The tray 21 is uniquely supported to move outwardly and inwardly between a part receiving position (FIG. 1) and a part unloading position (FIG. 4) and also to move to a position as shown in dotted lines in FIGS. 1 and 3 enabling the lip 27 to remove parts 12 from the pins 20. In the present instance, the tray is supported by means of a bifurcated bracket 30 attached to the frame 14 by screws 31 and having a pair of downwardly projecting legs 32 and a pair of upwardly projecting legs 33, the latter legs straddling the tray. Pivotally connected at 34 to the upper ends of the upper legs 33 is a pair of links 35 whose lower ends are connected to the tray by a horizontal pivot 36 which extends beneath the bottom 24 of the tray approximately midway between the ends thereof. A second horizontal pivot 37 extends beneath the tray adjacent the discharge end 23 thereof and connects the tray pivotally to the upper ends of a pair of generally upright arms 38. An outwardly projecting arm 39 is secured rigidly to one of the upright arms 38 and is pivotally connected at 40 to the lower end of a vertical rod 41 whose upper end is pivotally connected at 42 to a horizontal bar 43. The latter is attached to and extends outwardly from the ram 17 and moves upwardly and downwardly with the ram during reciprocation of the punch 16.

Figure 6:
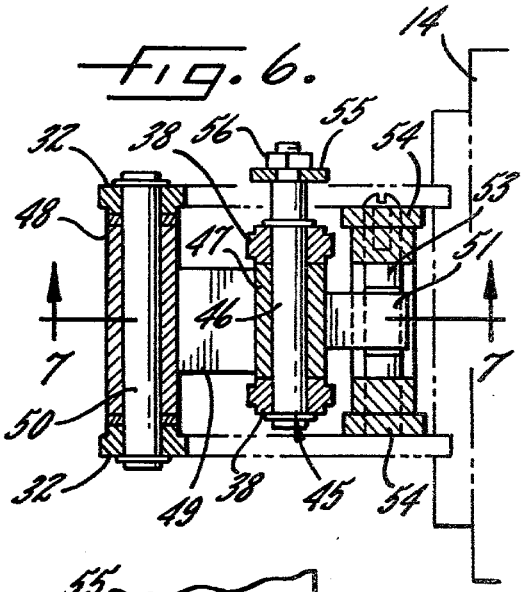
FIG. 6 is a fragmentary cross-section taken substantially along the line 6—6 of FIG. 1.

In carrying out the invention, the lower ends of the arms 38 are attached to a pivot 45 which is adapted to shift downwardly to enable the lip 27 of the tray 21 to remove parts 12 from the knock-out pins 20. As shown in FIG. 6, the pivot 45 is defined by a bolt 46 which extends through the lower ends of the arms 38. A bushing 47 is pivotally received on the bolt 46 between the arms 38 and is connected rigidly to a second bushing 48 by a welded strap 49. The second bushing 48 is located between the lower legs 32 of the bracket 30 and is adapted to pivot on a pin 50 which extends between the legs 32.

Figure 7:
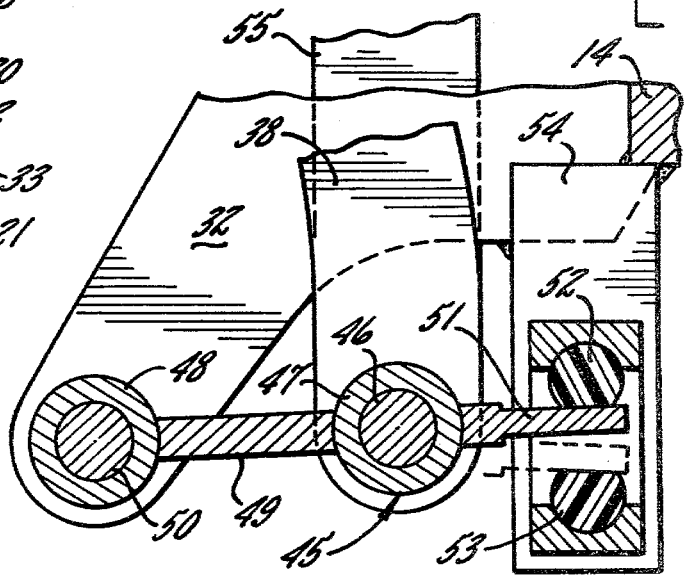
FIG. 7 is an enlarged fragmentary cross-section taken substantially along the line 7—7 of FIG. 6.

Welded rigidly to and projecting inwardly from the bushing 47 is a stop arm or tongue 51 (FIGS. 6 and 7) which fits between and is adapted to engage upper and lower stops 52 and 53. The stops are defined by vertically spaced and horizontally extending nylon rods which span a pair of mounting ears 54 secured rigidly to and projecting downwardly from the bracket 30.

Figure 2:
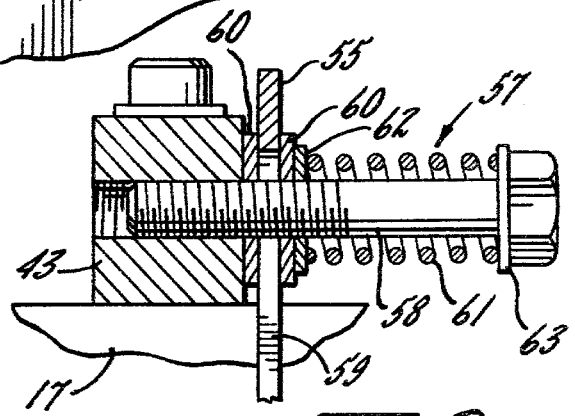
FIG. 2 is an enlarged fragmentary cross-section taken substantially along the line 2—2 of FIG. 1.

The unloading mechanism 10 is completed by an elongated and vertically extending link member 55 whose lower end is secured to the pivot bolt 46 by a nut 56 (FIG. 6). The upper end of the link 55 is connected to the bar 43 by a lost motion connection 57 (FIG. 2) which causes the link 55 to shift downwardly upon initial downward movement of the ram 17 but which enables the link to remain stationary during continued downward movement of the ram. Herein, the lost motion connection is formed by a screw 58 which extends through an elongated slot 59 formed in the upper portion of the link 55 and which is threaded into the bar 43. Friction washers 60 are telescoped onto the screw and are located on opposite sides of the link 55. A coil spring 61 is pressed between an additional washer 62 and the head 63 of the screw 58 and presses one of the washers 60 into frictional engagement with the link 55 while pressing the link into frictional engagement with the other washer 60 and pressing that washer into frictional engagement with the bar 43.

In order to explain the operation of the unloading mechanism 10, let it be assumed that the ram 17 has been moved upwardly to its fully retracted position shown in FIG. 1, that a part 12 has been pulled upwardly from the die 15 by the punch 16 and that the knock-out pins 20 have pushed the part off of the punch but that the part remains on the pins. When the ram is in this position, the tray 21 is inclined downwardly and outwardly with a gradual slope and is located in its part receiving position with the part receiving end 22 of the tray disposed beneath the part and with the lip 27 disposed inwardly of and below the part as shown in full lines in FIGS. 1 and 3. In addition, the link 55 is positioned with the screw 58 located near the upper end of the slot 59 and is positioned so as to hold the pivot 45 upwardly and cause the tongue 51 to be disposed in engagement with the upper stop 52.

When the ram 17 is first shifted downwardly to move the punch 16 toward the die 15, the link 55 is moved downwardly in unison with the ram by virtue of the friction created between the spring-loaded washers 60, the link and the bar 43. At the same time, the rod 41 is moved downwardly by the bar 43. As the link 55 moves downwardly, it shifts the pivot 45 downwardly and causes the tongue 51 to swing clockwise about the pivot 50 until the tongue engages the lower stop 53. Downward shifting of the pivot 45 pulls the arms 38 downwardly to cause the tray 21 to swing counterclockwise about the pivot 36 at the lower ends of the links 35. The tray thus is pivoted to the dotted line position shown in FIGS. 1 and 3 to cause the lip 27 to move alongside of the part 12 on the knock-out pins 20.

Downward shifting of the pivot 45 terminates when the tongue 51 engages the lower stop 53. At this time, the friction washers 60 slip to enable the screw 58 to move downwardly within the slot 59 in the link 55 and thus enable the link to remain stationary while the ram 17 continues its downward movement. During such downward movement, the rod 41 swings the arms 38 counterclockwise about the pivot 45 to cause the tray 21 to shift downwardly and outwardly from the position shown in FIG. 1 to the position shown in FIG. 4. As the tray thus moves, the lip 27 engages the part 12 on the knock-out pins 20 and brushes the part off of the pins so that the part may fall into the tray. With continued swinging of the arms 38, the receiving end 22 of the tray moves through the path shown in dotted lines in FIG. 4 and moves outwardly and downwardly from the path of the punch 16 so as to enable the punch to proceed toward the die 15. As the arms 38 approach the end of their stroke, the links 35 cause the tray 21 to swing counterclockwise about the pivot 37 thereby to increase the downward slope of the tray and to cause the part 12 to slide from the tray and into the bin 28 (see FIG. 4).

When the next part 12 has been punched and as the ram 17 is initially shifted upwardly, the link 55 moves upwardly with the ram by virtue of the friction established by the washers 60. During such movement, the pivot 45 and the arms 38 are pulled upwardly to cause the tray 21 to pivot slightly in a clockwise direction about the pivot 36 at the lower ends of the links 35. Thereafter, the tongue 51 engages the upper stop 52 to prevent further upward shifting of the link 55, the pivot 45 and the arms 38. As the ram continues to retract, the screw 58 slides up the slot 59 and, at the same time, the rod 41 swings the arms 38 clockwise about the pivot 45 to return the tray upwardly and inwardly to its part receiving position shown in FIG. 1. The tray reaches such position just after the punch 16 and the part 12 have been retracted upwardly out of the path of the tray.

I claim:

1. A mechanism for unloading a part from a machine having a movable tool and having a drive for reciprocating the tool upwardly and downwardly between lowered and raised positions, the part being carried upwardly with the tool as the latter moves upwardly, said mechanism comprising a tray having a part receiving end and a part discharging end, said tray having a bottom which slopes downwardly and outwardly upon progressing from said part receiving end to said part discharging end, said tray having a lip projecting upwardly from said bottom adjacent the part receiving end of said tray, means mounting said tray on said machine to move outwardly and inwardly between a part receiving position and a part unloading position and to increase the downward slope of the tray during outward movement and decrease the downward slope of the tray during inward movement, the part receiving end of said tray being located beneath said tool and said lip being located inwardly of said part when said tray is in said receiving position and said tool is in said raised position, the tray being located out of the path of said tool when said tray is in said unloading position, means connecting said tray to said drive and operable to move said tray outwardly to said unloading position as said tool moves downwardly and to move said tray inwardly to said receiving position as said tool moves upwardly, and means responsive to initial downward movement of said tool for causing the tray receiving end of said tray to move upwardly to locate said lip alongside said part and thereby cause the lip to knock the part off of the tool and into the tray as said tray moves outwardly as an incident to continued downward movement of said tool.

2. A mechanism for unloading a part from a machine having a movable tool and having a drive for reciprocating the tool upwardly and downwardly between lowered and raised positions, the part being carried upwardly with the tool as the latter moves upwardly, said mechanism comprising a tray having a part receiving end and a part discharging end, said tray having a bottom which slopes downwardly and outwardly upon progressing from said part receiving end to said part discharging end, said tray having a lip projecting upwardly from said bottom adjacent the part receiving end of said tray, an arm having upper and lower pivots, said upper pivot being connected to the part discharging end of said tray, said tray moving outwardly and inwardly between a part receiving position and a part unloading position when said arm is swung outwardly and inwardly about said lower pivot, a link having one end connected pivotally to said tray between the ends thereof and having an opposite end pivotally connected to said machine, said link causing said tray to swing about said upper pivot and causing the downward slope of said tray to increase and decrease as said tray is moved outwardly and inwardly, respectively, the part receiving end of said tray being located beneath said tool and said lip being located inwardly of said part when said tray is in said receiving position and said tool is in said raised position, the tray being located out of the path of said tool when said tray is in said unloading position, means connecting said arm to said drive and operable to swing said arm outwardly about said lower pivot to move said tray outwardly to said unloading position as said tool moves downwardly, and means supporting said lower pivot and operable to allow said lower pivot to shift downwardly through a limited range during initial downward movement of said tool, the part receiving end of said tray being swung upwardly about said one end of said link during downward shifting of said lower pivot and moving said lip alongside said part so as to cause the lip to knock the part off of the tool and into the tray as said tray moves outwardly as an incident to continued downward movement of said tool.

3. A mechanism as defined in claim 2 in which said supporting means comprise a member connected to said lower pivot, and means connecting said member to said drive and causing said member to move downwardly during initial downward movement of said tool and to remain stationary during continued downward movement of said tool.

4. A mechanism as defined in claim 2 in which said supporting means comprise an elongated member having a lower end which supports said lower pivot, a lost motion connection between the upper end of said elongated member and said drive, said lost motion connection causing said elongated member to move downwardly during initial downward movement of said tool and allowing said elongated member to remain stationary during continued downward movement of said tool.

5. A mechanism as defined in claim 4 further including means connected to the lower end of said elongated member and engageable with said machine to limit downward movement of said elongated member.

6. A mechanism as defined in claim 5 in which said last-mentioned means comprises a stop arm pivotally connected at one end to said machine and pivotally connected between its ends to said lower pivot, and upper and lower stops on said machine and engageable with the opposite end of said stop arm to restrict pivoting thereof.

* * * * *